United States Patent [19]

Ishikawa et al.

[11] 4,259,657

[45] Mar. 31, 1981

[54] SELF HEAT GENERATION TYPE POSITIVE CHARACTERISTIC THERMISTOR AND MANUFACTURING METHOD THEREOF

[75] Inventors: Kazuo Ishikawa; Kazuo Hosaka, both of Chitose, Japan

[73] Assignee: Matsushita Electric Industrial Co., Ltd., Kadoma, Japan

[21] Appl. No.: 37,951

[22] Filed: May 10, 1979

[30] Foreign Application Priority Data

May 17, 1978 [JP] Japan ..... 53-59210

[51] Int. Cl.[3] ..... H01C 7/02

[52] U.S. Cl. ..... 338/22 R; 29/612; 338/314

[58] Field of Search ..... 338/22–25, 338/28, 314, 316, 329, 327; 73/362 AR, 362 SC; 29/610, 612; 264/61

[56] References Cited

U.S. PATENT DOCUMENTS

| | | | |
|---|---|---|---|
| 2,769,071 | 10/1956 | Ward | 338/22 |
| 3,644,864 | 2/1972 | Hirsbrunner et al. | 338/22 SD |
| 3,683,469 | 8/1972 | Capek et al. | 264/61 X |
| 3,958,208 | 5/1976 | Blaha | 338/22 R |
| 4,163,769 | 8/1979 | Pope et al. | 264/61 |

*Primary Examiner*—C. L. Albritton

*Attorney, Agent, or Firm*—Stevens, Davis, Miller & Mosher

[57] ABSTRACT

A self heat generation type positive characteristic thermistor and a manufacturing method thereof. The thermistor is made of more than three layers of positive characteristic thermistor element bodies, such that the specific resistance of the layer situated nearer the surface in the direction of element thickness perpendicular to electrodes is higher. According to this invention a positive characteristic thermistor which generates heat instantaneously when a large current is flown therethrough and has excellent thermal shock proof properties can be obtained simply. The thermistor is well suited to mass production and the use of the thermistor can be extended to many fields.

4 Claims, 4 Drawing Figures

SELF HEAT GENERATION TYPE POSITIVE CHARACTERISTIC THERMISTOR AND MANUFACTURING METHOD THEREOF

This invention relates to a self heat generation type positive characteristic thermistor having excellent thermal shock proof properties or (antithermal shock properties) and a manufacturing method thereof.

A positive characteristic thermistor whose specific resistance increases with a temperature rise due to Joule heating is widely used in the fields of current control, excess current prevention, a demagnetization apparatus, a constant temperature heat generation body, etc. As a recent trend, the use of a positive characteristic thermistor in a quick response mode of heating the thermistor instantaneously by flowing a large current therethrough has been widely followed. However, since the material for such a thermistor contains barium titanate as its main constituent, the heat conductivity of the element is not good. When a large current is forced to flow, a temperature difference appearing between the surface and the interior of the element causes cracking of the element, which has been for practical purposes, a large drawback.

An object of this invention is to provide a self heat generation type positive characteristic thermistor which suppresses thermal shock due to self heat generation, and a method for manufacturing the same.

Embodiments of this invention will be explained hereinafter with reference to the accompanying drawings, in which.

Figure 1:
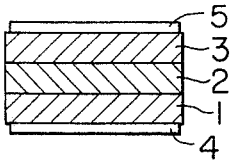
FIG. 1 is a cross-sectional view of an embodiment of a positive characteristic thermistor obtained by this invention.

In FIG. 1, reference numerals 1, 2 and 3 denote positive characteristic thermistor elements containing barium titanate as a main constituent and constituted in the form of layers. Surface elements 1 and 3 are formed by a material with a specific resistance higher than that of the material of the central element 2. Raw material powders of the elements 1, 2 and 3 are filled into a metal mold in this order and molded by pressure in the direction of thickness from top and bottom to form a united molded body. After the body is fired and sintered, electrodes 4 and 5 are fitted to the surface elements 1 and 3 to obtain a positive characteristic thermistor. In the prior art, the same manufacturing process has been used, except that material powder with a constant specific resistance has been used. Although in FIG. 1 a case of three layers is treated for the sake of explanation, multi-layers with more than three layers may be formed in the same way as described above, by constructing the layers such that the specific resistance of the layer situated nearer the surface of the thermistor in the direction of element thickness is higher.

Next, the validity of this invention will be described with reference to a concrete embodiment of this invention in comparison with the prior art.

Figure 2:
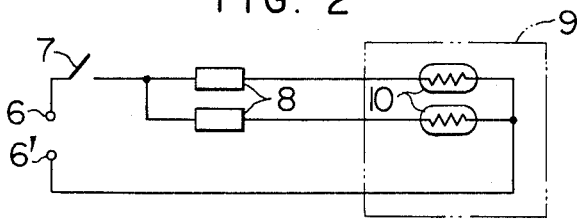
FIG. 2 is an electric circuit diagram showing a test circuit for the positive characteristic thermistor.

Using a metal mold of 17 mm $\phi$, a central element with a specific resistance of 13 Ω·cm and a thickness of 1.3 mm and two surface elements with a specific resistance of 50 Ω·cm and a thickness of 1.3 mm were molded. Thereafter, the molded body was fired for two hours at 1350° C. Aluminium was melted and fused on to form electrodes, and copper wires of 0.6 mm $\phi$ were soldered to the electrodes to obtain a finished product as a sample. The initial room temperature resistance was 11.7 Ω. For the sake of comparison, using material with a specific resistance of 40 Ω·cm as one of prior art, a sample of prior art was made in a method similar to one as stated above. The initial room temperature resistance for the latter sample was 12.0 Ω. Evaluation of thermal shock proof properties for the above two samples was made by use of the test circuit shown in FIG. 2, where numerals 6 and 6' denote AC power source terminals. The voltage of the power source was set at 280 V. 7 denotes an ON-OFF timer; 8 denotes a load of 10 Ω; 9 denotes a low temperature bath set at −20° C.; and 10 denotes a positive characteristic thermistor sample. ON and OFF cycles of the ON-OFF timer 7 were set at 1 and 5 minutes respectively. After 10,000 cycles of ON-OFF test, cracking in the thermistor was examined.

In all the 10 samples of the prior art thermistor cracks occurred, and therefore the resistance values thereof increased excessively, whereas, in the 10 samples of this invention no abnormality or abnormal phenomenon occurred and the rate of change of the resistance was within ±10%. Thus a good result was obtained. Further, experiments were made as to other embodiments of this invention and a good result was obtained, as shown in the following table.

| No. | Specific resistance of raw material (Ω · cm) Element 1 | Element 2 | Element 3 | Thickness of molded material (mm) Element 1 | Element 2 | Element 3 | Firing temperature (°C.) | Initial resistance (Ω) | Rate of defect | Remarks |
|---|---|---|---|---|---|---|---|---|---|---|
| 1 | 50 | 13 | 50 | 1.1 | 2.3 | 1.1 | 1350 | 11.0 | 0/10 | Embodiment of this invention |
| 2 | 87 | 13 | 87 | 1.0 | 2.0 | 1.0 | 1350 | 12.0 | 0/10 | Embodiment of this invention |
| 3 | 50 | 13 | 50 | 1.3 | 1.3 | 1.3 | 1350 | 11.7 | 0/10 | Embodiment of this invention |
| 4 | 40 | 40 | 40 | 1.3 | 1.3 | 1.3 | 1350 | 12.0 | 10/10 | Prior art example |

The elements 1, 2 and 3 in the Table are the same as those of FIG. 1. Samples No. 3 and No. 4 are one according to this invention and one of the prior art in the above-mentioned experiments.

Figure 3A:
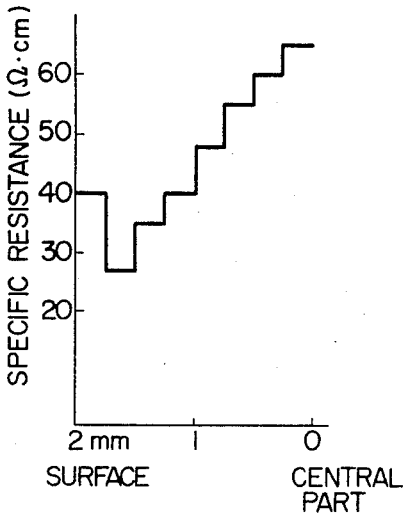
FIGS. 3A and 3B show distributions of resistance in the direction of element thickness of a prior art thermistor and the inventive thermistor, respectively.
Figure 3B:
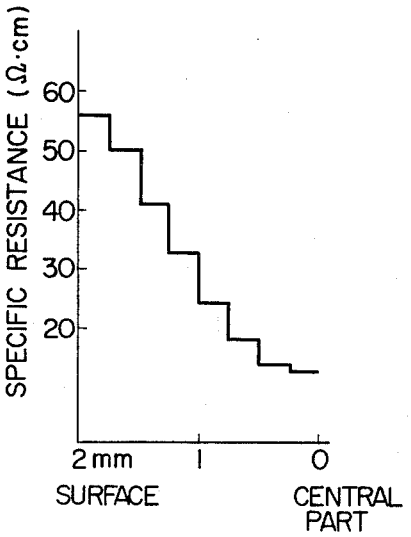

FIG. 3 shows a result of examination of the resistance distribution in the direction of element thickness of the samples after firing. Both surfaces of an element with a thickness of about 4 mm were polished (by lapping) by 0.25 mm respectively. After every polishing, In-Ga electrodes were attached to both surfaces of the sample to measure the value of resistance, and the specific resistance was calculated and plotted. FIG. 3A shows the distribution of the specific resistance of the sample No. 4 according to the prior art, where powdered bodies of the same resistance were molded and fired. Except near a portion of the surface, the specific resistance of the fired element is such that the specific resistance of a layer or portion situated nearer the central part is higher. FIG. 3B shows the distribution of the specific resistance of the sample No. 1 according to this invention. It is seen that the specific resistance of layer or portion decreases as the layer or portion is situated nearer the central part. Thus, in the prior art device, when a large current is flown therethrough instantaneously, the heat generation density due to self heating becomes larger nearer the inner part and temperature rises higher at an inner part than at the surface, and it is considered that for this reason the temperature difference in the direction of element thickness increases to such an extent as to form cracks. On the other hand, in the device of this invention, the density of heat generation becomes smaller nearer the inner part, therefore, the temperature distribution in the direction of element thickness becomes uniform. It is considered that for this reason the cracking of the element does not occur.

The positive characteristic thermistor of this invention is constructed as described above, and according to this invention it is possible to obtain a positive characteristic thermistor which has excellent thermal shock proof properties when a large current is flown therethrough while generating heat instantaneously. So, the thermistor can be applied to usage in many fields. By not increasing the material cost and the number of steps with use of a multilayer molding machine, the manufacturing method of this invention is efficient in mass production.

What we claim is:

1. A self heat generation type positive characteristic thermistor comprising at least three layers of positive characteristic thermistor element bodies, the specific resistance of said layers being such that the specific resistance of the layers decreasing from the outermost layers to the center of said thermistor.

2. A self heat generation type positive characteristic thermistor according to claim 1, wherein said positive characteristic thermistor element bodies have a barium titanate system as a main constituent.

3. A method of manufacturing a self heat generation type positive characteristic thermistor comprising steps of filling positive characteristic thermistor elements layerwise in at least three layers using the materials of different specific resistances such that the specific resistance of the layers decreasing from the outermost layers to the center of said thermistor.

4. A method of manufacturing a self heat generation type positive characteristic thermistor according to claim 3, wherein a material with barium titanate as a main constituent is used for said materials.

* * * * *